United States Patent [19]

Rosen

[11] Patent Number: 5,036,604

[45] Date of Patent: Aug. 6, 1991

[54] ADJUSTABLE FOOT SUPPORT SYSTEM

[76] Inventor: Henri E. Rosen, 229 Coolidge Ave., Watertown, Mass. 02172

[21] Appl. No.: 441,970

[22] Filed: Nov. 28, 1989

[51] Int. Cl.[5] ..... A43B 7/14

[52] U.S. Cl. ..... 36/88; 36/91; 36/139; 128/591

[58] Field of Search ..... 36/43, 44, 88, 93, 91, 36/97, 139; 128/591, 596, 600

[56] References Cited

U.S. PATENT DOCUMENTS

| | | | |
|---|---|---|---|
| 3,541,708 | 11/1970 | Rosen | 36/97 |
| 3,686,777 | 8/1972 | Rosen | 36/97 |
| 3,777,419 | 12/1973 | Nalick | 128/596 X |
| 3,791,375 | 2/1974 | Pfeiffer | 36/139 X |
| 3,888,242 | 6/1975 | Harris et al. | 36/88 X |
| 4,731,940 | 3/1988 | Zanatta et al. | 36/44 X |
| 4,858,341 | 8/1989 | Rosen | 36/97 |

FOREIGN PATENT DOCUMENTS

| | | | |
|---|---|---|---|
| 2113070 | 8/1983 | United Kingdom | 36/97 |

*Primary Examiner*—Jimmy G. Foster
*Assistant Examiner*—Beth Ann Cicconi
*Attorney, Agent, or Firm*—Bruce F. Jacobs

[57] ABSTRACT

An orthotic element for use in shoes is adjustable by the wearer in contour and/or support, and optionally includes structure for determining the degree and effectiveness of the adjustment. The adjustment mechanism also provides for variation of the axial canting of the bottom surface of the foot relative to the horizontal walking surface.

21 Claims, 7 Drawing Sheets

ADJUSTABLE FOOT SUPPORT SYSTEM

BACKGROUND OF THE INVENTION

It is possible that many of today's foot problems connected with pronation and related strain of the plantar fascia, the foot's connective tissue, stem from the fact that the foot, evolved over literally millions of years of walking on soft earth and has not yet completely adapted to the predominantly hard and flat surfaces of today's floors and pavements. This theory seems to be supported by the fact that most feet, when not weight-bearing, tend to have transverse contours under the metatarsal phalanx (MP) joints, or 'ball' substantially raised from the horizontal on the inner side edge or 'varus' as opposed to the outer side, or 'valgus.' This can be easily observed when sighting by eye along the plantar surface of the ball as against that of the comparatively horizontal bottom surface of the heel when the foot is non-weightbearing. As the ball of the foot rotates inwardly in the shoe from an unweighted tilted state to a weighted, horizontal state on the floor or pavement thereunder, this rotation is often accompanied by an excessive inward rotation of the arch area. This results in undue pronation or flattening thereof with the attendant discomfort, and often orthopedic damages associated therewith.

Past efforts to deal with this problem can be generally divided into four categories. The first includes shoes and/or footbeds non-adjustable contoured in manufacture to better support the bottom of the foot, or portions thereof. Examples of this approach can be found in the footbed products of the Atlantic Thermoplastics of Woonsocket, R.I., which are sold by Florsheim Co. of Chicago, Ill., and others.

The second category includes shoes and/or footbeds custom molded to the foot and non-adjustable thereafter. Examples of these are disclosed in U.S. Pat. Nos. 2,092,909 and 2,092,910 as well as in the custom-manufactured shoes of Tru-Mold ® Shoes, Inc. of Buffalo, N.Y. and others, whereby the shoes are custom molded in manufacture to fit the contours of the client's feet, from a cast, usually plaster, thereof. Similar results are obtained using footbeds and the like, relatively non-adjustable after customizing, including orthotics directly molded to the foot such as those of Orthofeet Orthotic Systems of Hillsdale, N.J. Even the best of such permanent contouring approaches represent less than ideal compromises in that they can not be readily readjusted to the changes in support needs often encountered in the problem foot.

The third category of solutions to these problems include orthotic elements, readjustable generally by experts, i.e. podiatrists or orthopedists working with their own or outside laboratories. Such elements include a wide range of products, such as the PreformS ® from Berkemann Podiatry Products of Mt. Kisco, N.Y., which include orthotics preformed to a preferred average contouring but readjustable in contour by the application of heat and pressure, and/or by the additions of shims or like elements in a procedure known as 'posting.' All of such orthotics are designed to be adjusted by a podiatrist or similar specialist having both the tools and experience to do so, rather than by the end user, who usually lacks both. Similar approaches in the prior art also include the flexible inserts disclosed in U.S. Pat. No. 4,439,936. Other somewhat similar approaches include that described in U.S. Pat. No. 3,306,967 in which resinous foams can be formed for use in footbeds or insole inserts requiring temperatures and equipment normally precluding such adjustment by the consumer. Furthermore, even such products on the market that are conceivably wearer-adjustable, provide no means for the normally unskilled wearer to ensure a safe and proper adjustment of the shoe. These products include somewhat readjustable plastic foam based inserts, such as those sold by P.W. Minor & Son, Inc., of Williamsville, N.Y., under the trade names of Minorplast ® and Plastamold ®, both designed for adjustment by podiatrist or similar skilled professional, and both somewhat prone to losing at least some of their support characteristics over time. It should also be noted that orthotics requiring adjustment by podiatrists or the like are usually not only relatively expensive, but also frequently necessitate multiple office visits by the wearer to obtain satisfactory results.

The last category of proposed solutions includes adjustable canting means designed for end-user adjustment. This category seems to be limited to downhill or 'alpine' skiing applications, wherein a variable transversely rotational axial canting of the foot is used to improve the edge control of the ski. Such products, which include the Flexon ® boots distributed by Raichle Molitor U.S.A. Inc., of Brewster, N.Y., the VX Racer with its adjustable Symflex ® heel device, available from Sanmarco of Italy and others, are designed for use with the currently standard rigid ski boot sole, and as such are not practical for use in general footwear which must flex at least at the ball, during the gait cycle. Likewise, the Nava Skiing System available through Nava Leisure U.S.A., Inc. is also completely impractical for adaptation to general footwear, since it controls leg canting rather than the foot canting required in general shoe applications.

Thus, there still remains a real need for orthotic foot-canting devices that can be adjusted as needed by the end user in a simple and safe manner, preferably but not necessarily under the guidance of podiatrists, trainers or similar specialists.

SUMMARY OF THE INVENTION

Accordingly one of the objects of the present invention is to provide orthotic elements for use in shoes, having means for the wearer to adjust the contour and/or support thereof, together with optional means for determining the degree of the adjustments and the relative effectiveness thereof.

It is a further object of the invention to provide means for the simple and accurate adjustment of the axial canting of the bottom surface of a foot relative to a horizontal walking surface, especially where such adjustment can be done by an educated wearer.

For a fuller understanding of the nature and objects of the present invention, reference should be made to the following detailed description taken in connection with the accompanying drawings.

DETAILED DESCRIPTION OF THE INVENTION

Figure 1:
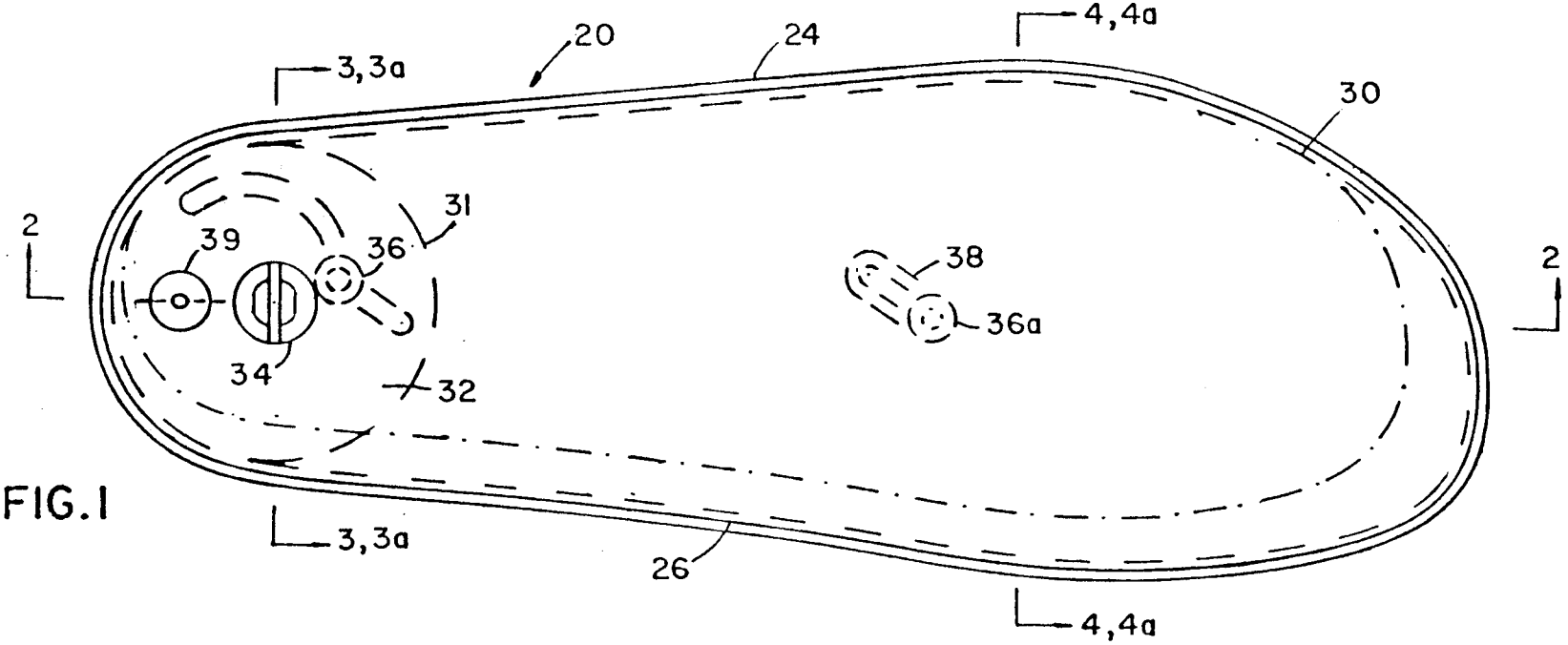
FIG. 1 is a plan view of a footbed embodying principles of the present invention.
Figure 2:
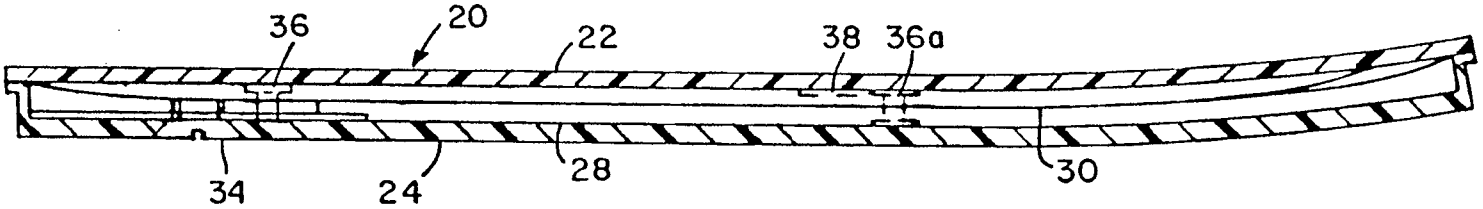
FIG. 2 is a side elevational cross-section of the footbed of FIG. 1, taken along line 2—2 thereof.

The adjustable supports and optional monitoring system will be described with reference to a footbed assembly designed for insertion into shoes though it should be recognized that the adjustable supports can be incorporated within a unitsole in a similar manner. Referring to the drawings, FIGS. 1 through 5 show one embodiment of the present invention. As best shown in FIGS. 1 and 2 footbed assembly 20 comprises sock 22 attached to footbed base 24 by a suitable means such as heat sealing so as to define a cavity. Disposed within the cavity are a stationary insole 28, a movable insole 30, and an adjustment means 31, including cam 32, slotted cam adjusting screw 34, and retaining rivets 36 and 36a, by which movable insole 30 and adjustable cam 32 are fastened to each other in movable contact relative to insole 28 and the rest of footbed assembly 20.

While the members of the footbed assembly 20 may be manufactured from any suitable materials, it is presently preferred to employ a sock 22 composed of a polypropylene sheet, faced on its top surface with a polypropylene fabric socklining material. Footbed base 24 and insole members 28 and 30 are preferably made of molded polypropylene, although other suitable materials such as polyethylene, polyester elastomers, polyvinylchloride and polyurethanes may be used instead.

Footbed assembly 20 is designed to be located within the bottom portion of a shoe and to allow adjustment of the axial rotational transverse canting of the footbed and therefore the foot thereon when the foot is in the shoe. As shown, the footbed is designed to deal with various degrees of undue pronation or inward rotation of the foot with a range of axial cant or tilt of from about 0° to 3° positive, where 0° provides a substantially horizontal transverse foot supporting base while a positive cant of up to 3° counters and corrects for excessive pronation by providing an upward tilt or cant towards the inner or medial side of the foot, about 0° to 3° positive being considered a safe and practical range for user adjustment, and suitable for most cases of typically moderate pronation. Alternatively, the footbed could be designed with a greater canting range and/or to include provision for negative canting of about 0° to 2° negative, to deal with supination, the less frequently experienced excess outward axial rotation of the foot.

Figure 3A:
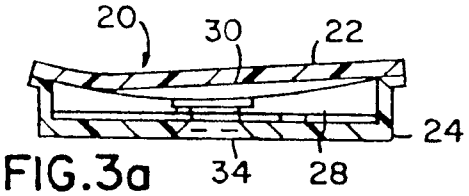
FIGS. 3 and 3*a* are transverse elevations of the footbed of FIG. 1 taken along line 3, 3*a*—3, 3*a* thereof.
Figure 3:
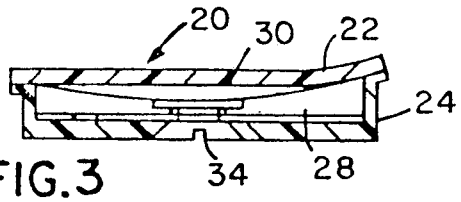

The operation of the footbed assembly can best be described with reference to the drawings. As shown in FIGS. 1 and 2, movable insole 30 is attached to the rear of footbed assembly 20 by rivet 36 located in the cam slot of cam 32. Movable insole 30 is also slidably attached to insole 28 by rivet 36a, which operates in slot 38 in the forepart of element 30. As cam 32 is turned in a clockwise direction, the arcuate cam slot therein increases in its radial distance from the center of cam adjusting screw 34 fastened thereto, moving insole 30 forward and inward on the top surface of insole 28. FIGS. 3 and 3a show transverse sections at the cam, which better show the mechanics of the canting action, whereby the forward motion of movable insole 30, moves it in its angled tracks at rivets 36 and 36a from the 0° cant shown in FIG. 3 to the 3° positive cant shown in FIG. 3a. This positive canting results as the convexly curved bottom surface of member 30 moves circumferentially and transversely relative to the substantially matching and contiguous concavely curved top surface of insole element 28, to its extreme of 3° of positive cant shown in FIG. 3a. The resulting curvatures on the top inner right edge of FIG. 3 and outer left edge of FIG. 3a are not relevant to the canting angles, as they occur in locations where the side edges of the foot tend to curve upward in a similar fashion.

Figure 4A:
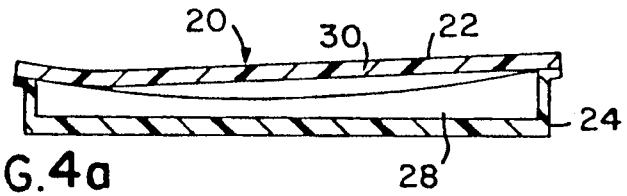
FIGS. 4 and 4a are transverse elevations of the footbed of FIG. 1 taken along line 4, 4a—4, 4a thereof.
Figure 4:
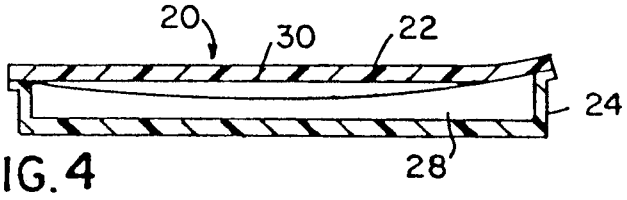
Figure 5:
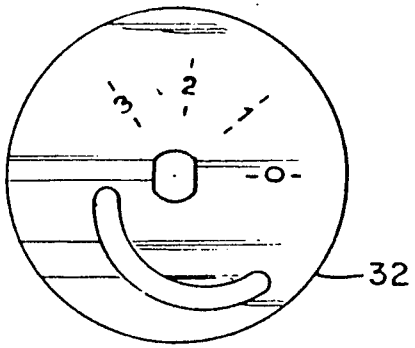
FIG. 5 is a plan view of the adjusting cam plate shown in FIG. 1.
Figure 6:
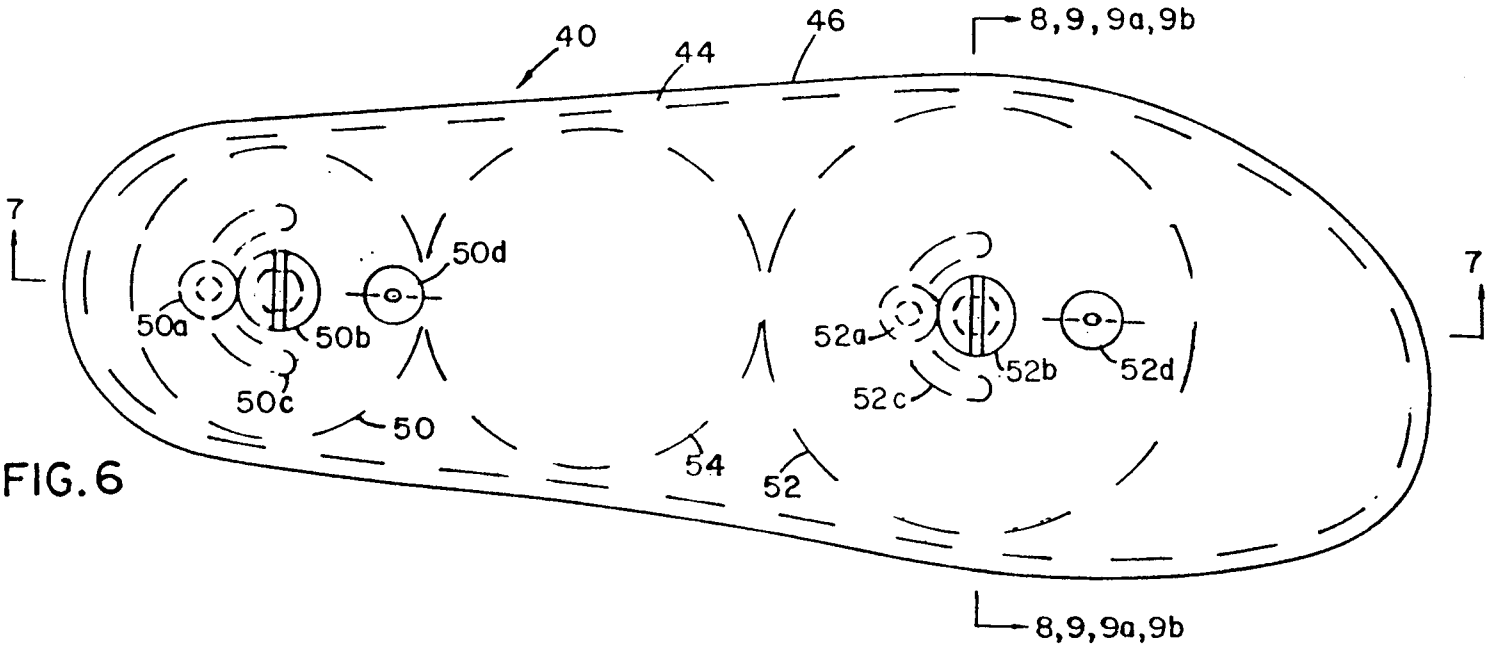
FIG. 6 is a plan view of another footbed incorporating principles of the present invention.
Figure 7:
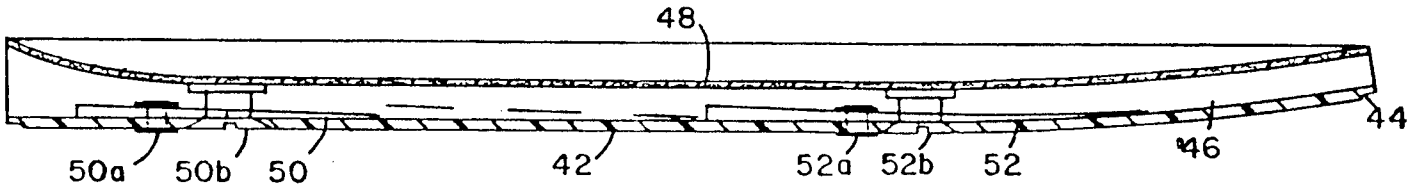
FIG. 7 is a side elevation of the footbed of FIG. 6.

Similarly, FIGS. 4 and 4a show a transverse section at the ball of the foot, with a 0° cant shown on FIG. 4 and the full 3° positive cant shown on FIG. 4a. FIG. 5 shows a plan view of cam 32 with optional index numbers showing the relative canting in degrees from 0° to 3°, depending on the position of the cam and said numbers thereon relative to the transparent window 39 shown in FIG. 1, in the heel area of footbed assembly 20. Of course, the degree of canting can be adjusted to any value between 0° and 3° depending upon the degree of rotation of cam 32. While not shown, the degree of canting may be increased to beyond 3° or made negative by changing the cam design and the shape of the movable insole 30.

Figure 8:
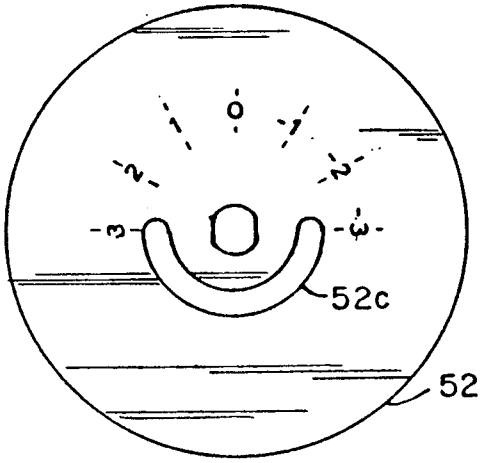
FIG. 8 shows one of the rotary shims of the footbed assembly of FIG. 6.

Another embodiment of the invention is shown in FIGS. 6-9b, whereby foot canting is effected by the use of rotary shims in a footbed having elastic walls. The elastic walls could be formed by molding the footbed of suitable types of plastic, including cellular ethylene vinyl acetate, polyurethane, and the like. As shown, footbed assembly 40 comprises footbed bottom plate 42 fastened by a suitable means such as heat sealing to footbed base 46, the latter being faced on its upper surface with a socklining 48 of suitable material such as polypropylene fabric or similar materials available from Strarensier Corp. of Newburyport, Mass. and others. Footbed assembly 40 also comprises rotary canting shims 50 and 52 at heel and ball regions, respectively, with a similar optional arch shim 54 shown only in dashed outline therebetween. Adjustment is effected by turning adjusting screws 50b and 52b fastened to shims 50 and 52 and extending therefrom to the bottom surface of bottomplate 42. The rotation of shims 50 and 52 is limited by the ends of the arcuate shim slot openings 50c and 52c when either comes into contact with rivets 50a and 52a, which are fixedly attached to bottom plate 42. As shown, shims 50 and 52 are designed to give adjustable canting of from about −3° to +3°, and are infinitely adjustable within that range. While not required, the shims preferably have numbers or other indices thereon to indicate the degree of effective cant at various shim rotational settings. As shown in FIG. 8, these indices comprise numbers printed on shims 50 and 52 corresponding to negative and positive degrees of axial cant, with the appropriate numbers being displayed in transparent windows 50*d* and 52*d*, provided in bottom plate 42.

Alternatively, numbered or equivalent indices could be designed for display in other areas, as in the side of the sole assembly in the heel area through a window therein, similar to the windows used to display inside heel structure as in some of the Nike Air® models of Nike, Beaverton, Oreg., and others.

Figure 9:
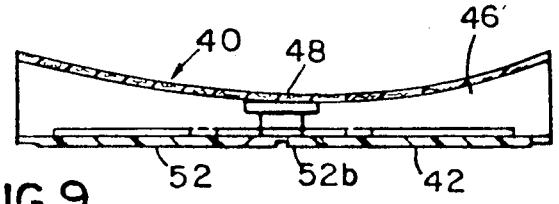
FIGS. 9, 9a and 9b show transverse sections of typical adjustments of the shim of the footbed assembly of FIG. 6, taken along line 8, 9, 9a, 9b—8, 9, 9a, 9b thereof.
Figure 9A:
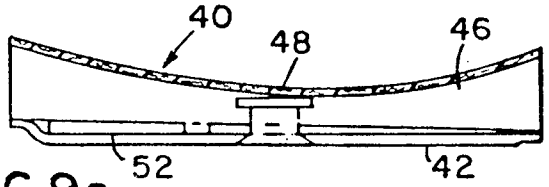
Figure 9B:
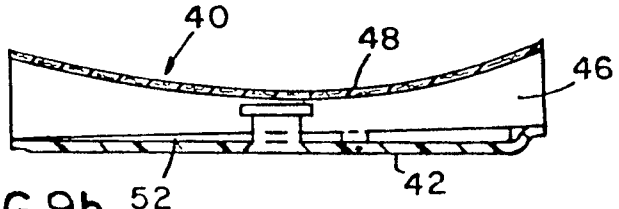

FIGS. 9, 9*a* and 9*b* show the transverse ball sections of the footbed assembly at 0°, −3° and +3° cant respectively, a range within which adjustment by a podiatrist or similar professional would normally be advisable. Similar products designed primarily for wearer adjustment would be provided with a cam slot of a lesser range, preferably one allowing canting only from about 0° to +3°, as shown on the preceding embodiment in FIGS. 1 to 5. Other adjustable canting arrangements (not shown) where the canting means are included in the footbed and/or shoe are considered equivalent to the foregoing, including arrays of ('sawtooth') staggered opposing ramps which, when moved within the footbed or shoe, change the effective height of a portion of their surfaces adjacent to the bottom of the foot thereon, as well as transversely curved elements wherein the concave and convex surfaces of the embodiment of FIGS. 3, 3*a*, 4, and 4*a* are reversed to accomplish the same result.

It should also be noted that foot canting as described herein appears to also be a useful alternative to the usual molded orthotics previously cited in that the canting of this invention allows the weight to be mostly borne by areas that are normally weight-bearing, including the ball and heel as well as the outer or 'lateral' side of the bottom of the foot, rather than having any unusual weight-bearing pressure introduced in the foot's medial arch or adjacent areas, as is usually the case with today's orthotic inserts used in the backparts of shoes.

Footbed base 46 is made of any suitable material such as ethylene vinyl acetate, polyvinylchloride, and heat-sealable polyurethanes. The footbed bottom plate is generally constructed of similar materials as the base. The shims 50, 52 and 54 are manufactured of polypropylene, high density polyethylene, and the like; although polypropylene is presently preferred.

Another embodiment of this invention is shown in FIGS. 10 to 16, which disclose additional means to evaluate the degree of axial rotation of the stance of the weight-bearing foot, particularly as such stance relates to the particular cant angle adjustments of the previous embodiments. For ease of reference, these means are shown as they would appear on a footbed assembly, either the same as or different from the footbed assemblies of the embodiments of FIGS. 1 to 9. However, the footbed assembly of this embodiment is particularly useful together with the footbed assembly of the previous embodiments. In fact, it is presently preferred to include the footbed assembly of this embodiment in the embodiments of FIGS. 1 to 9. Alternatively, the footbed assembly of FIGS. 10 to 14 could be used separately, as in childrens or other shoe categories, where this embodiment could be useful not only for testing the degree of axial rotation of the weight-bearing foot, but also as a training means to enable wearers to improve their gait control habits and foot health.

Referring now to the drawings, footbed assembly 60 comprises footbed base 62 attached to a socklining 64. The base 62 may be manufactured of any suitable material although it is presently preferred to employed a molded cellular plastic such as ethylene vinyl acetate or polyurethane. The socklining 64 is preferably made from any of the usual suitable socklining materials such as Cambrelle® non-woven fabrics and laminates distributed by Faytex Corporation of Braintree, Mass., socklinings from Stareniser Corporation of Newburyport, Mass., leather, fabrics and the like. The socklining is attached to the footbed base by means such as adhesive, flame-combining, or even integrally molding therewith. The footbed assembly also comprises an arch adjustment assembly 66 housed within the footbed base 62.

Such arch adjusting assembly 66 is both separate and additional to the canting adjustment means in the previous embodiments, and optionally may be included together with the footbed assemblies of FIGS. 1 to 9 where more or less canting of the arch is required than is available with the canting adjustment means of the previous embodiments of FIGS. 1 to 9.

Figure 10:
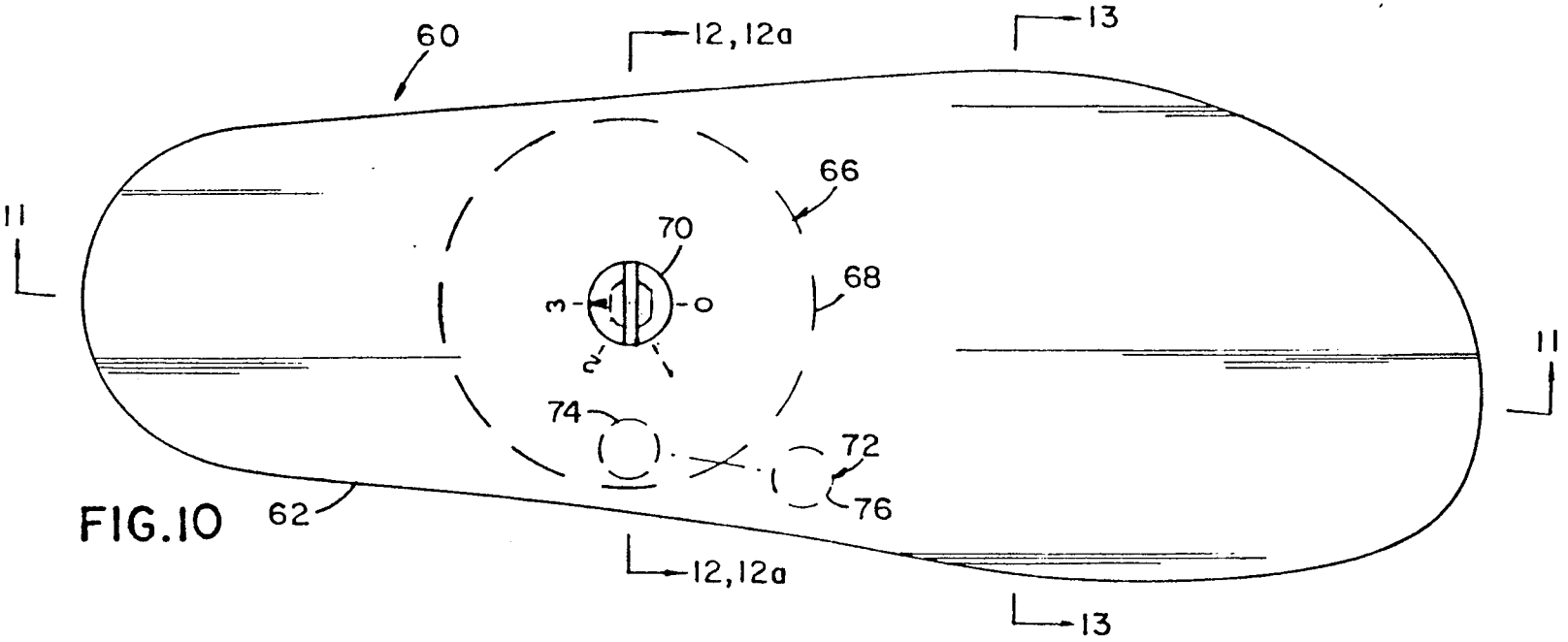
FIG. 10 is a plan view of another footbed assembly embodying principles of the present invention.
Figure 11:
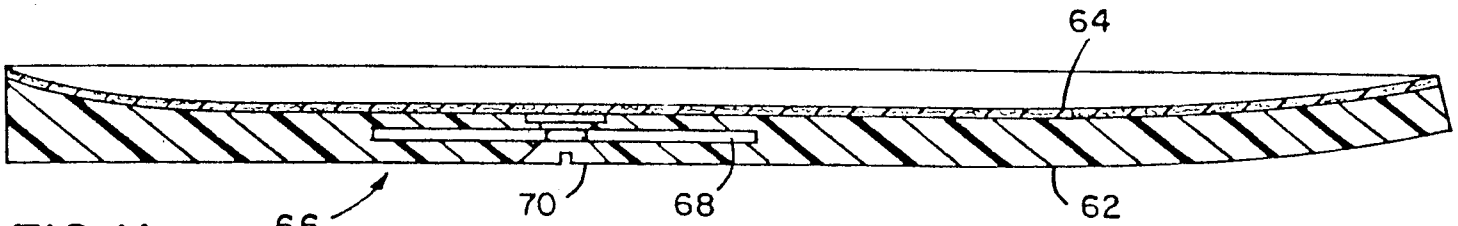
FIG. 11 is a side elevation of the footbed assembly of FIG. 10, taken along line 11—11 thereof.

As shown in FIGS. 10 and 11, arch adjustment assembly 66 comprises rotatably adjustable shim 68 with shim adjusting screw 70 attached thereto. The shim 68 is preferably marked to indicate the degree of arch adjustment relative to the canting degree number markings 0° to 3° on the bottom of footbed base 62 adjacent to the visible head of adjusting screw 70.

Figure 12A:
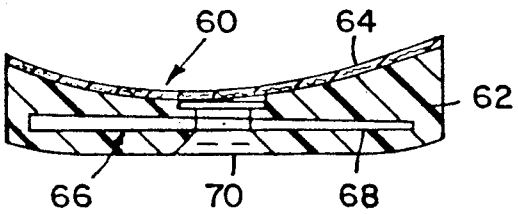
FIGS. 12 and 12a are transverse sections of the footbed assembly of FIG. 10 taken on line 12, 12a—12, 12a thereof.
Figure 14:
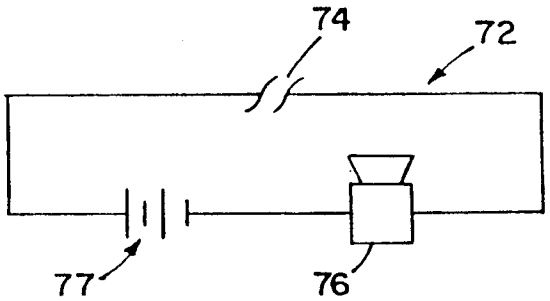
FIG. 14 is a circuit diagram of the electronic signalling means shown in the footbed assembly of FIG. 10.
Figure 12:
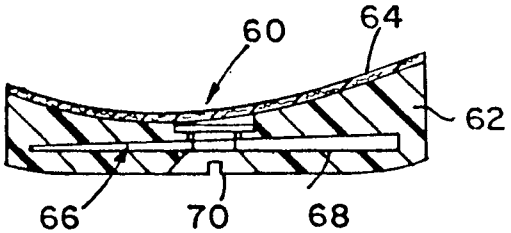
Figure 13:
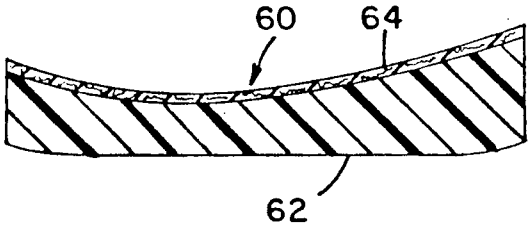
FIG. 13 is another transverse section of the footbed assembly of FIG. 10 taken on line 13—13 thereof.

FIGS. 12 and 12*a* show sections of the footbed assembly 60 including arch adjustment assembly 66 as the footbed would appear adjusted to its minimum arch cant in FIG. 12, and to its maximum arch cant in FIG. 12*a*.

The footbed assembly 60 also contains a signalling means 72 located generally adjacent to and under socklining 64. The signalling means comprises a pressure sensitive switch 74 located in the arch area of the shoe, and an audio source 76 and a power source 77 which may be located in the arch area or outside of it. The signalling means may be located anywhere in the arch area, including as far back as the forepart of the heel and as far forward as the backpart of the ball. The preferred circuit is best shown by itself in FIG. 14.

In operation, the signalling means 72 of this embodiment is designed to provide an intermittent audible beeping or chirping sound whenever the arch area rotationally pronates to a degree sufficient to put enough pressure on pressure sensitive switch 74 which is in the arch area to close the circuit and actuate the audio signal. By varying the degree of canting by the use of the canting adjusting means of this invention, the wearer can test the cant of his weight-bearing foot, both while standing as well as during the gait cycle. The wearer can also, by use of the removable footbed assembly containing the signalling means, check on his stance and gait pronation control in conventional non-canted footwear. Should the user want to deactivate the signalling means at any time, this can be done either by removing the battery from the footbed or turning to off an on-off switch (not shown) in the circuit.

In general, electrical and/or electronic means of signalling are the preferred means, offering not only a greater latitude of design for limited space usages, but also because they permit ongoing signalling not only during the gait cycle, but also while the wearer/user is merely standing.

Figure 15:
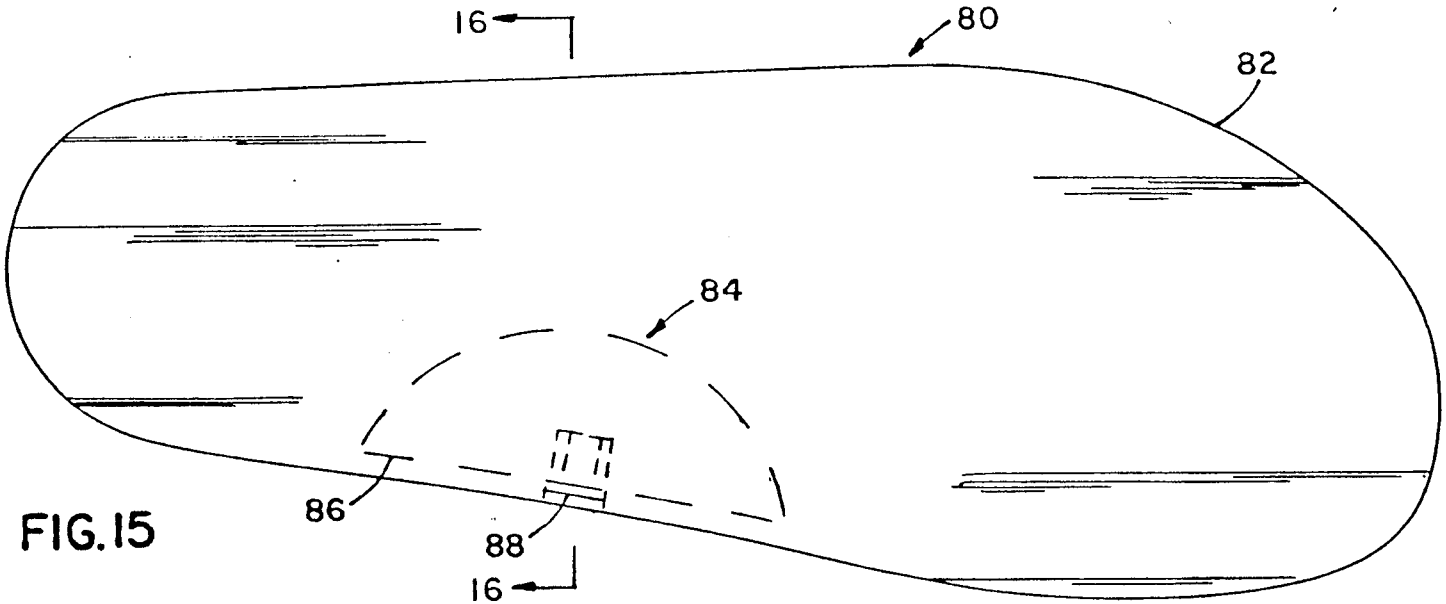
FIG. 15 is a plan view of another footbed assembly embodying principles of the present invention.
Figure 16:
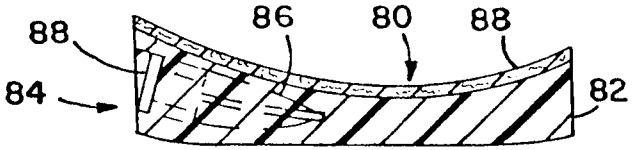
FIG. 16 is a transverse section of the footbed assembly of FIG. 15 taken on line 16—16 thereof.

Alternative signalling means include noise-makers such as air-activated plastic squeakers and spring-activated 'crickets' (dished spring noisemakers), both distributed by P. Sernau & Co. of N.Y.C., N.Y. and others. For example, as shown in FIGS. 15 and 16, a footbed assembly 80 comprises a footbed base 82, having an air-activated bellows-type noisemaker assembly 84 molded in the base 82 or optionally inserted into a cavity molded in the base. The noisemaker assembly 84 comprises a molded plastic bellows 86 and a voice or 'squeaker' 88 inserted therein. The squeaker 88 comprises a molded tubular container with a reed arrangement inserted therein, designed to emit a squeaking sound whenever sufficient air is forced out of bellows 86 by pressure thereon. The noisemaker assembly is designed to emit an audible signal whenever appreciable pressure is applied ot the arch area and the air bellows 86 therein as a result of excessive pronation of the wearer's foot in that area. Silencing such signalling means at the wearer's preference merely requires removal of squeaker 88 from the neck opening in bellows 86 into which it is press-fitted when in use.

Other alternative signalling means include tactile signalling means which signal by means of a pattern of rounded raised portions, such as bumps or protrusions 100 in the area of the arch. The protrusions would be pressed against the wearer's foot at times of excessive pronation of the arch thus providing a tactile signal to the wearer. The bumps or protrusions could be similar to those used on the Noppy ® sandals sold by Birkenstock ® of Novajo, Calif., but would differ in that they would be provided only under the arch, to signal pronation thereof, rather than in full contact with weight-bearing areas of the foot.

Alternatively, the signaling means can be used in the absence of the canting adjusting means to enable an individual to determine the need for canting adjustment.

It should be understood that the aforementioned designs and approaches represent only a few applications of the concepts of this invention and that many other designs and combinations of materials for use in removable footbeds or elements built into the shoe are possible under the teachings of the present invention.

What is claimed is:

1. An assembly within in a shoe comprising a foot supporting member having a cant and a ball portion, an arch portion, and a heel portion for supporting a foot having ball, arch and heel portions and adjustment means connected to the foot supporting member for adjusting the cant of at least one of the ball portion and the heel portion of the foot supporting member, thereby adjusting the cant of at least a portion of the foot supported by the foot supporting member.

2. The assembly of claim 1, wherein the foot supporting member comprises a base member having a top surface and a recessed area in its top surface and a sock member disposed along the top surface of the base member so as to define a cavity therebetween, a movable insole member disposed within the cavity and attached to the adjustment means.

3. The assembly of claim 2 wherein a non-movable insole member having a concave upper surface is disposed below the movable insole member in the cavity, said movable insole member having a convex lower surface which moves relative to the concave upper surface of the non-movable insole member.

4. The assembly of claim 2 wherein a non-movable insole member housing a convex upper surface is disposed below the movable insole member in the cavity, said movable insole member having a concave lower surface which moves relative to the convex upper surface of the non-movable insole member.

5. The assembly of claim 2, wherein the adjustment means includes a cam.

6. The assembly of claim 5, wherein the cam has indicia thereon for indicating the cant.

7. The assembly of claim 1, wherein the adjustment means is a rotatable shim member.

8. The assembly of claim 7, wherein the shim member is located at a point of the assembly which will correspond to the heel portion of the foot when in use is the shoe.

9. The assembly of claim 7, wherein the shim member is located at a point of the assembly which will correspond to the ball portion of the foot when in use is the shoe.

10. The assembly of claim 7, wherein the shim member has a screw attached thereto for use in rotatable adjustment of said shim member.

11. The assembly of claim 10, wherein the shim has indicia thereon for indicating the cant.

12. The assembly of claim 7, additionally containing a rotatable shim member located at a point of the assembly which will correspond to the arch of the foot when in use in a shoe.

13. The assembly of claim 1, additionally containing a signalling means for signalling a wearer of the shoe.

14. The assembly of claim 13, wherein the signalling means produces an audible signal.

15. The assembly of claim 13, where the signalling means produces a tactile signal.

16. The assembly of claim 13, wherein the signalling means is battery powered.

17. The signalling means of claim 15, wherein the tactile signal comprises protrusions which press against the arch of the foot.

18. A shoe containing the assembly of claim 1.

19. A shoe containing the assembly of claim 13.

20. The assembly of claim 1, wherein the ball portion is adjusted.

21. The assembly of claim 1, wherein the heel portion is adjusted.

* * * * *